US006666278B2

(12) United States Patent
Cicanese

(10) Patent No.: US 6,666,278 B2
(45) Date of Patent: Dec. 23, 2003

(54) OIL WELL FIRE SUPPRESSION DEVICE

(76) Inventor: Frank Cicanese, 25276 Rampart Blvd., Punta Gorda, FL (US) 33983

( * ) Notice: Subject to any disclaimer, the term of this patent is extended or adjusted under 35 U.S.C. 154(b) by 186 days.

(21) Appl. No.: 10/051,690

(22) Filed: Jan. 22, 2002

(65) Prior Publication Data

US 2003/0146004 A1 Aug. 7, 2003

(51) Int. Cl.[7] ..... A62C 11/00; A62C 2/00; A62C 8/00; A62C 37/10

(52) U.S. Cl. ..... 169/30; 169/46; 169/49; 169/60

(58) Field of Search ..... 169/30, 49, 46, 169/47, 50, 51, 60, 66, 69, 67, 68, 70; 166/363, 364

(56) References Cited

U.S. PATENT DOCUMENTS

| | | | | |
|---|---|---|---|---|
| 4,972,904 A | * | 11/1990 | Godare | 166/97 |
| 5,115,869 A | * | 5/1992 | Flavio | 169/69 |
| 5,121,797 A | * | 6/1992 | DeCuir, Sr. | 166/386 |
| 5,131,474 A | * | 7/1992 | Hunter, III | 169/46 |
| 5,158,138 A | * | 10/1992 | DeCuir, Sr. | 166/90 |

* cited by examiner

*Primary Examiner*—Davis D Hwu
(74) *Attorney, Agent, or Firm*—Frank A. Lukasik

(57) ABSTRACT

The present invention relates to oil well fire suppression devices, a self contained fire suppression device serving the dual purposes of extinguishing an oil fire and thereafter sealing the well against further leakage and re-ignition. The containment vessel physicaly contains and extinguishes the fire within seconds, channels and controls escaping oil and gas, and plugs the well with a removable bladder. Heat activated valves release liquid nitrogen into the fire column to use the force of the fire to suck nitrogen into the flame and thereby assisting in extinguishing the fire.

4 Claims, 5 Drawing Sheets

OIL WELL FIRE SUPPRESSION DEVICE

BACKGROUND OF THE INVENTION

1. Field of the Invention

The present invention relates to oil well fire suppression devices and more particularly to a portable, self contained fire suppression device serving the dual purposes of extinguishing an oil well fire and thereafter sealing the well against further leakage and re-ignition.

2. Background

In the recent Gulf war, Iraqi forces ignited over 600 oil wells in an effort to eliminate Kuwait's oil infrastructure. The conflagration lasted from February 1991 until Nov. 6, 1991. During this period it is estimated that the daily loss of oil and natural gas was between 4–6 million barrels and 100 million cubic meters respectively.

The two major problems encountered by firefighters in Kuwait were lack of equipment and lack of water. Cranes to lift the wellheads, backhoes to dig around the wellheads, dozers to build roads and move debris and equipment to fight the fires were in short supply and desperately needed for the firefighting to begin in earnest. Existing pipelines used to carry oil from gathering stations in the oilfields to the Persian Gulf were reversed to carry saltwater from the Gulf back to the oilfields to fight the fires. The logistical problems involved in pumping the 1.5 billion gallons of water that was eventually used to fight the fires slowed the flow of water to a trickle.

It was discovered that extinguishing the fire was not the most difficult part of well control. It's what is done after the fire is out that is dangerous. As long as the well is blowing, there is a possibility the well could flash and re-ignite, injuring or killing everyone on location. This dangerous potential is why one can't wait for water, or to borrow equipment from the next location. Everything has to be in place to cap the well once the fire is out. The less time spent capping the well after the fire is out, the less likely someone gets hurt.

Prior art methods for extinguishing well fires utilized vast quantities of water or explosive charges to snuff out the fire after which the well had to be approached for capping. Approaching the well was often complicated by the build-up of coke around the site which required excavation to be carried out in dangerous proximity to the gushing well. The risks are obvious.

The present invention is deployed using a large bulldozer such as a Caterpillar D11. The unit is attached to a hydraulically controlled frame mounted to the front of the bulldozer. The unit can be raised and lowered in order to position it over the well fire.

The unit operator is protected within a protective cab equipped with air conditioning, window cleaning systems, two-way radio communications, and an emergency escape plan/egress system.

SUMMARY OF THE INVENTION

In a preferred embodiment the present invention provides a portable, self contained containment device for extinguishing oil well fires. It is a primary objective of the device to be able to rapidly deploy to a well fire site and, with a minimum of logistical preparation consisting simply of filling tanks within the containment device, and positioning it over the fire.

It is a further object of the invention to construct the containment vessel in a manner which utilizes well known principles of science to physically contain and extinguish the fire within seconds, channel and control escaping oil and gas, and plug the well with a removable bladder. The bladder being capable of withstanding well head pressures up to 800 psi. such as those found in wells in the Middle East It is a further object of the invention to use escaping oil to cool the containment vessel and well head environment.

It is a further object of the invention to use heat activated valves to release liquid nitrogen into the fire column to use the force of the fire to suck the nitrogen into the flame thereby assisting to extinguish it.

In Operation

It is a further object of the invention to follow a sequence of deployment as follows;

1. Fill a water containment cylinder
2. Fill Nitrogen tanks
3. Open oil and gas escapement valves
4. Add sand to the leveling box to equalize weight
5. Approach vessel with lifting equipment
6. Raise containment vessel to 12" above well head keeping the bottom of the vessel below the flames.
7. (If necessary) Proceed to the well at the direction of two spotters
8. Lowering the vessel in place once it is over the well casing. (It need not be perfectly centered)
9. Using the deployment vehicle as additional ballast to keep the vessel in place adds a further 203,000 pounds to the initial weight of the vessel (38,000 pounds.)

It is a further object of the invention to follow the above deployment sequence to initialize the extinguishment/containment sequence;

1. Cessation of oxygen to the flame
2. Heat activated nozzles release nitrogen
3. Perforated internal baffles break oil down
4. Flame is extinguished in 5–8 seconds
5. Vessel begins to fill with oil aiding cooling of the vessel
6. Gas release valve is slowly closed forcing remaining energy and flow of oil through the oil release valve
7. Once oil temperature is reduced sufficiently, oil release valves are slowly closed. Oil is now contained.
8. Expandable bladder is inserted into the well casing to restrict the flow of oil and gas.
9. With the bladder in place approximately 10' to 20' into the casing, the top of the bladder shaft can be removed, the oil drained from the vessel which can then be removed.
10. A "Christmas tree" manifold is fitted to the well casing providing a second valve containment means
11. Pressure is released from the bladder which is then raised above the level of the Christmas tree valve. Once it is above the level of the lower valve, it can be closed to complete the containment process.

Vessel Deployment

Utilizing a vehicle such as a Caterpillar D11, a continuous lifting beam is attached to each side. The lifting beam extends 30' from the center pin to the front or lifting section. The beam extends 24' to the rear of the center pin. Attached to the rear section are a pair of hydraulic cylinders. As the vessel approaches the well, the operator places the containment vessel in place as described. The rear cylinders are then activated and pressed into the ground lifting the bulldozer off the ground thus transferring its weight to the base of the containment vessel.

General Specifications

The following are the general specifications for a first embodiment of the invention;

1. (FIG. 1-12) Water containment Cylinder (1) 10' diameter, 10'1" high with a wall thickness of ½" steel. Approximate weight 6,444 lbs. Purpose: to provide ballast, will contain approximately 13,000 lbs of water which will also serve as coolant.
2. (FIG. 1-21) Oil containment Vessel (1) 15' high, 5' diameter, wall thickness 1" steel, approximate weight 9,525 lbs. Purpose: When placed over the well, it will penetrate the sand, sealing off the oxygen from the bottom. It will then fill with oil becoming as temporary of permanent containment vessel.
3. (FIG. 1-22,22') Steam relief vents (2) Size—6" pipe 5' long. Will release steam from the water containment cylinder.
4. (FIG. 1-41) Primary baffle (1) Size, 5' diameter cone with flat top plate that has 36 2" holes. Thickness—1" plate. Purpose: To reduce the oil from one solid cylinder (column) to 32 individual cylinders thus reducing pressure.
5. (FIG. 1-42) Secondary Baffle (1). Size 5' diameter 30 degree cone. Thickness ½" plate with 1" holes. Purpose: The further reduce oil particle size and thus oil pressure.
6. (FIG. 1-43) Third baffle (1) Size 5' diameter 15 degree cone. Thickness, ½" plate with ¾" holes. Purpose: Same as second baffle.
7. (FIG. 1-21*a*) Fourth baffle (1) 5' diameter plate. Thickness ½" plate with ½" holes. Purpose: Same as other baffles.
8. (FIG. 1-18*a*) Drain for water containment cylinder (4) Size, 4" pipe with ball valve. Purpose: To drain hot water from the cylinder to allow for cool water to be pumped in.
9. (FIG. 1-24) Gate Valve (1) Size—12". Purpose: To control energy being released from fire and well head.
10. (FIG. 1-18*a*) Horizontal relief and control pipe. Size—8" pipe. Purpose: Primary purpose is to release pressure in the vessel, the secondary purpose is to control the flow of oil.
11. (FIG. 1-19 one only shown) Gate valves (2) Size—8". Purpose: To control the flow of oil.
12. (FIG. 1-18*b*) Check valve (1) Size—8". Purpose: To prevent the flow of oxygen to the vessel. Will also allow for the flow of oil when required to so do.
13. (FIG. 1 22,22') Water Pipe Connection (4) Size—4" pipe with quick connects. Purpose: To allow the flow of water into the water containment cylinder.
14. (FIG. 1-50,50') Liquid Nitrogen Cylinder (4) Size 10"–48". Purpose: To immediately cool the oil vessel while simultaneously extinguishing the fire.
15. (FIG. 1-50*a*, 50*a*') Insulation packs (4) Size—4" mineral wool batt with protective covering. Purpose: To prevent overheating of the nitrogen tanks.
16. (FIG. 1 21*c*) Spray foam insulation. Thickness—1½". Purpose: To protect the oil vessel wall during flame suppression. Possible products—Fendolite M-11, Albi clad #800, Pyrocrete 241 or Kaowal Firemaster board.
17. (FIG. 1 16) Ballast Box. (1) Size 2'×10'×3". Wall thickness—½" steel. Purpose: To equalize weight and balance the unit. Can be filled with sand as required.
18. (FIG. 1 51,52) Nitrogen Piping and Heat controlled nozzles. (4) Size—4" pipe. Purpose: To transfer Nitrogen from the tank to the vessel, with the nozzles releasing nitrogen at a specified temperature.
20. Ladder for maintenance purposes.
21. (FIG. 3 30) Motor unit to lower the shaft and bladder into the well casing.
22. (FIG. 3 92, 47) Shaft and bladder.

DETAILED DESCRIPTION OF THE INVENTION

Figure 1:
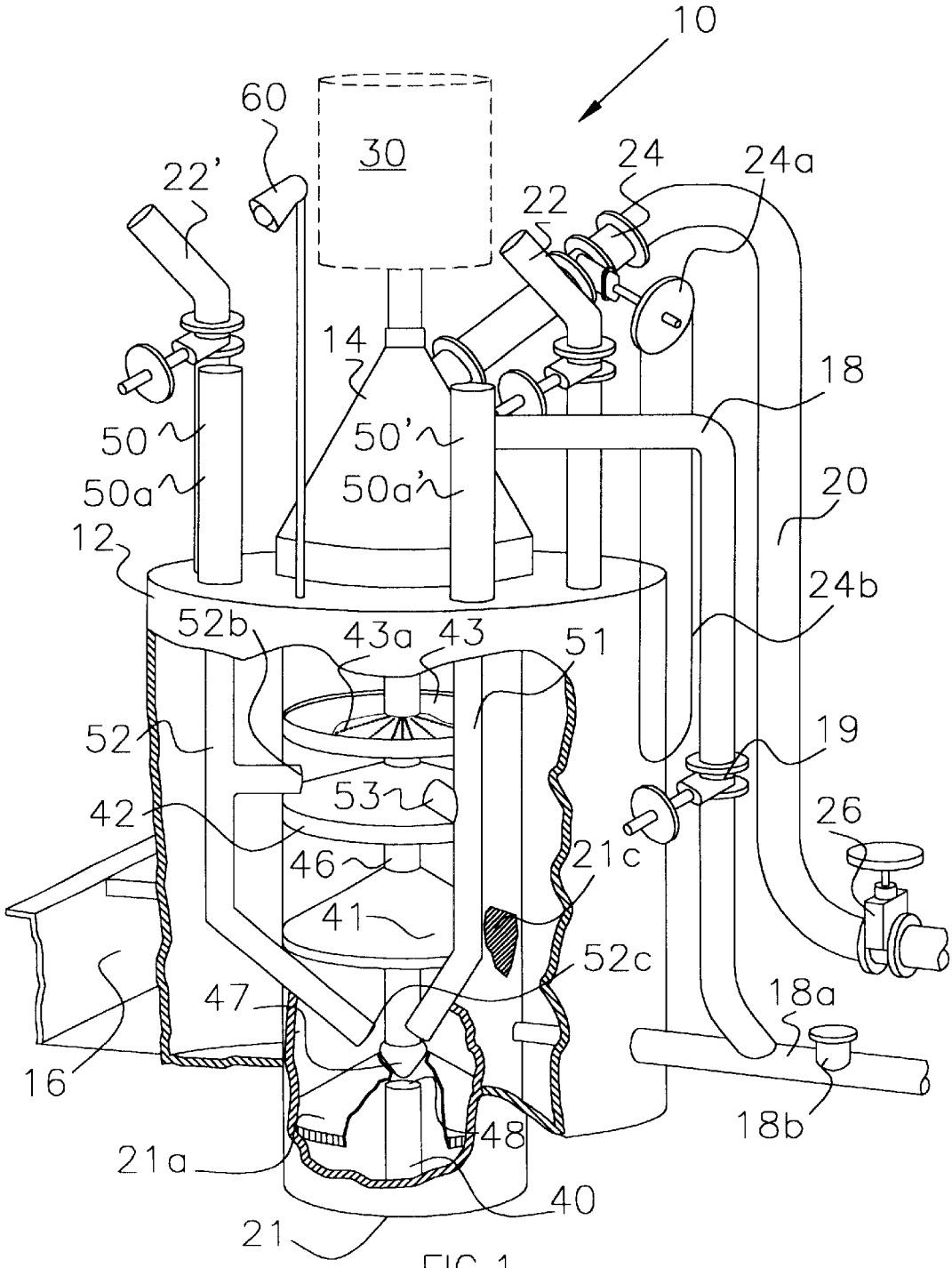
FIG. 1. is an isometric view partially in section of the oil well fire containment unit.

Referring now to the drawings wherein like numerals designate like and corresponding parts throughout the several views, in FIG. 1 the unit is designated overall by the numeral 10. water containment vessel 12 is filled through fill pipes 22 and 22'. Ballast box 16 can be filled with sand. Oil containment vessel 21 encases baffles 41,41*a*, 42 and 43. Well head 40 is covered by oil containment vessel 21. Oil gushing from well head opening 48 is forced up toward lower baffle 41*a* then to baffles 41, 42 and on up to baffle 43. Holes 43*a* (shown only in baffle 43) permit oil to fill container 21. As oil enters container 21, heat activates nitrogen release valves 52*b* and 52*c* and nitrogen is released from tanks 50 and 50' down pipes 51 and 52. Gas is released through vent pipe 20 through control valves 24 and 26. Valve 24 is controlled by wheel 24*a* which can be turned using chain 24*b*. Oil can be released through pipe 18 controlled by valve 19. Oil containment vessel 21 can be drained through outlet pipe 18*a*. Center pipe 46 houses the shaft 92 (FIG. 3) which moves bladder 47 down into well head 40. Motor controls for shaft 92 are contained in motor unit 30. Lights 60 illuminate the scene for night operation.

Figure 2:
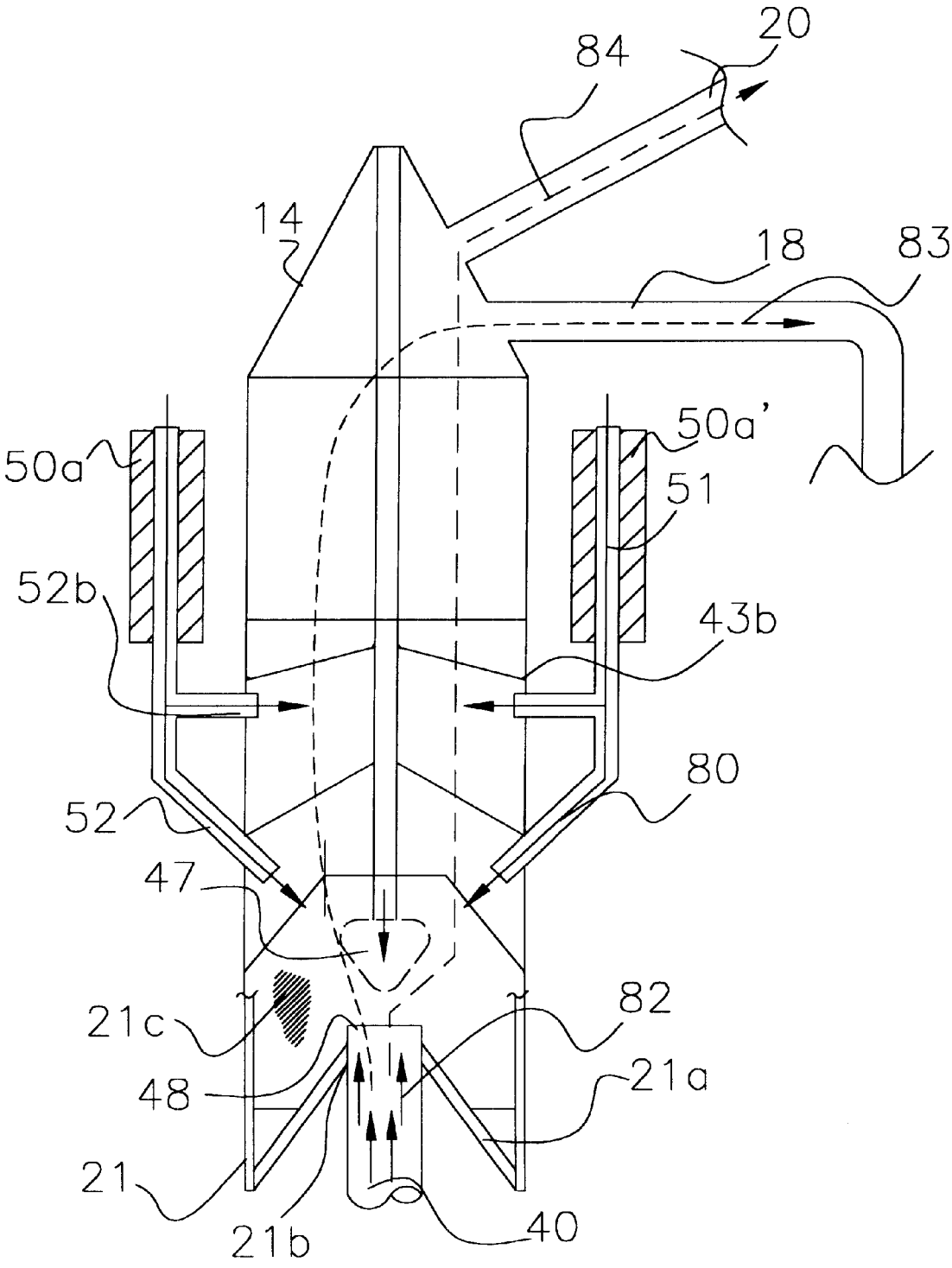
FIG. 2. is a diagrammatic illustration of the oil well fire containment unit as it operates.

Referring now to FIG. 2. burning oil and gas 82 go up through oil containment vessel 21. Gas 84 vents through pipe 20 and oil 83 vents through pipe 18. Nitrogen vents through pipes 51 and 52 in the direction of arrow 80. Bladder 47 is lowered into well head 40 through opening 48.

Figure 3:
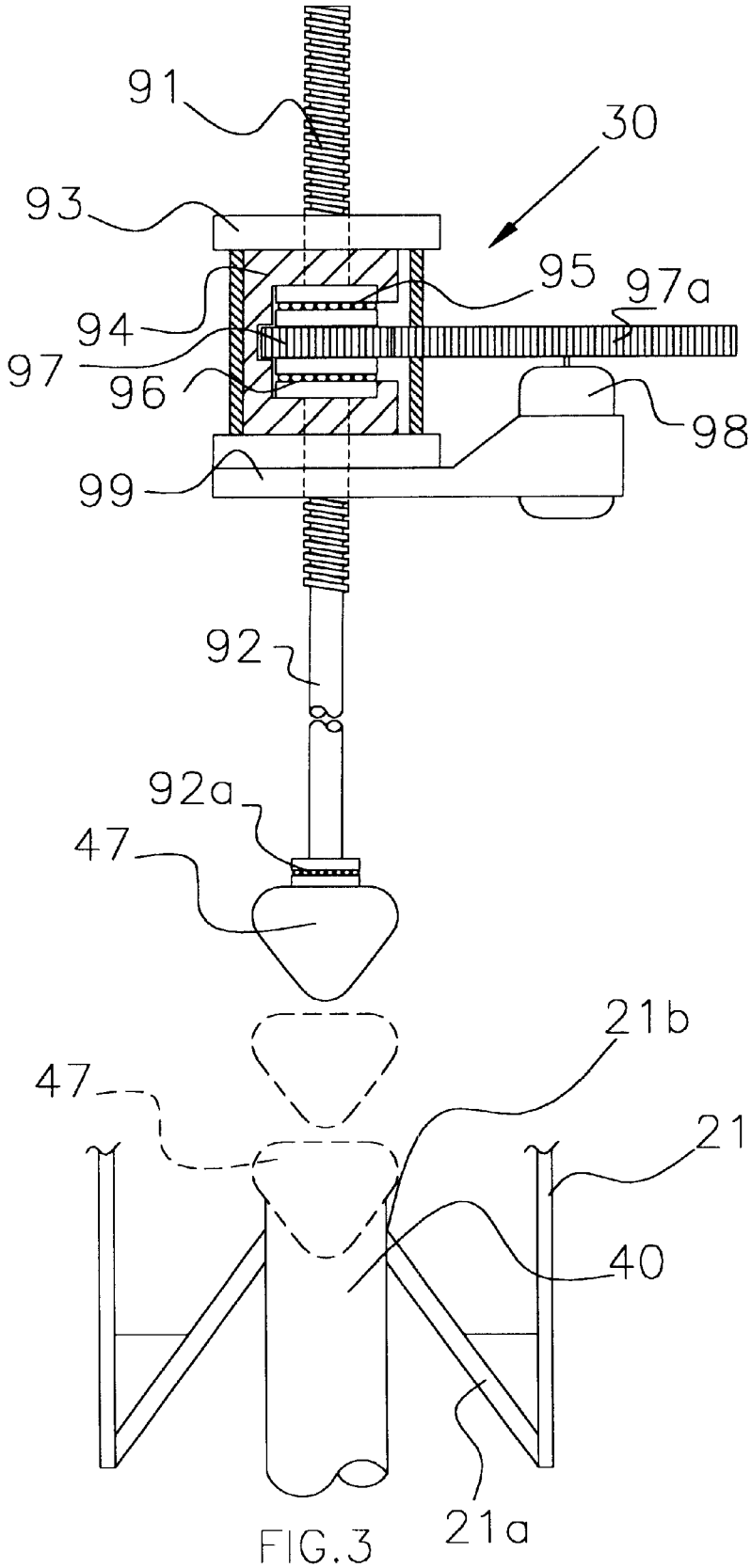
FIG. 3 is an elevational view partially in section of the oil well sealing unit.

Referring now to FIG. 3 in which motor unit 30 is illustrated. Screw thread 91 connected to shaft 92 is turned by gear 97 and 97*a* driven by motor 98. Thrust bearings 95 and 96 in housing 94 in casing 93 allow shaft 92 to rotate while under pressure. Mounting bracket 99 keeps the rotating components from binding while the unit is operating. Bladder 47 is lowered into well head 40 as shaft 92 is screwed downward.

Figure 4:
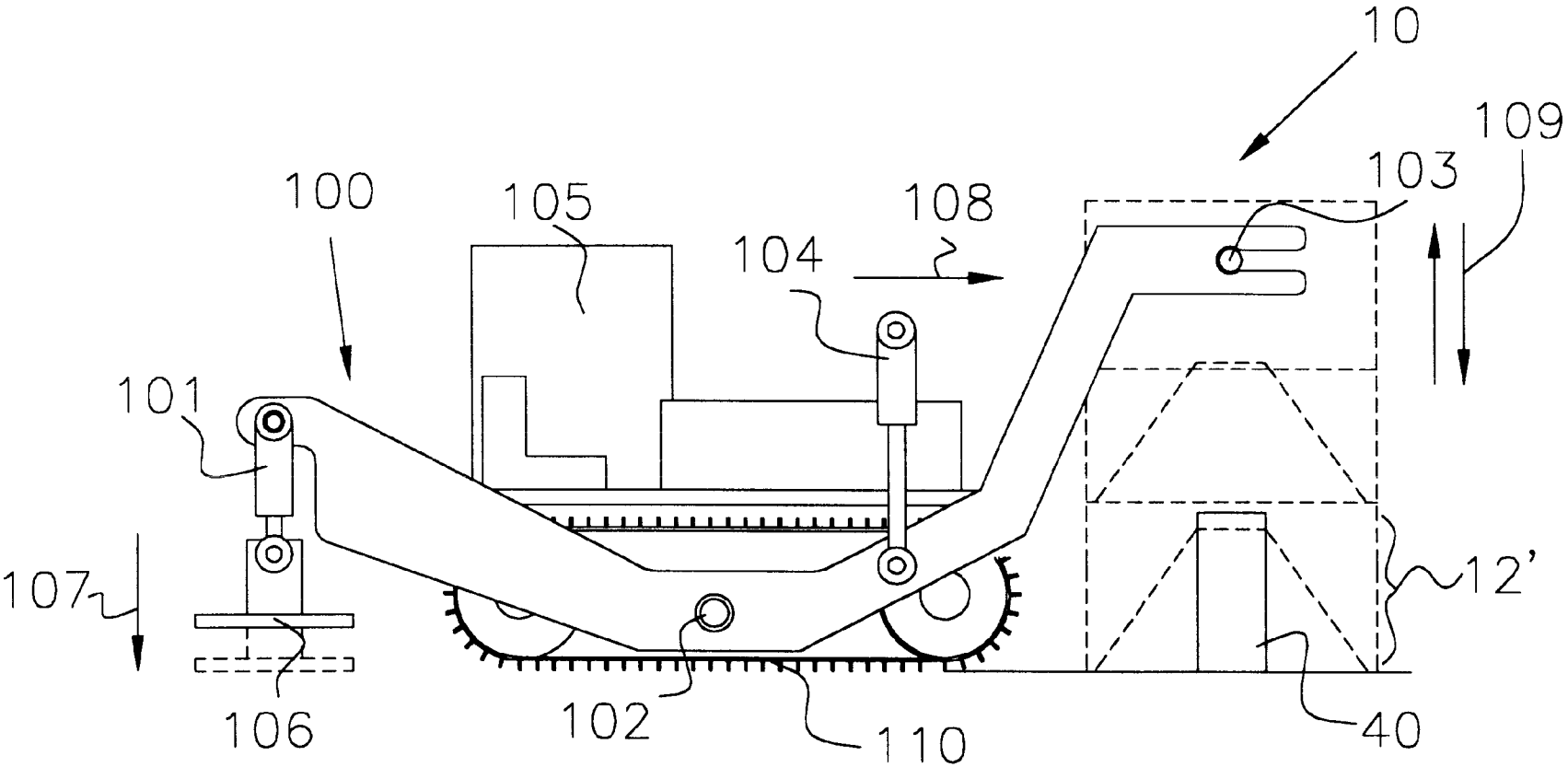
FIG. 4 is an elevational view of the deployment means for the oil well fire containment unit.
Figure 8:
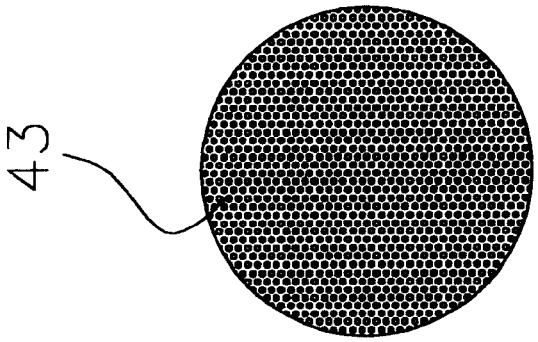
FIGS. 5–8 are plan views of the baffles showing their differing screen sizes.
Figure 7:
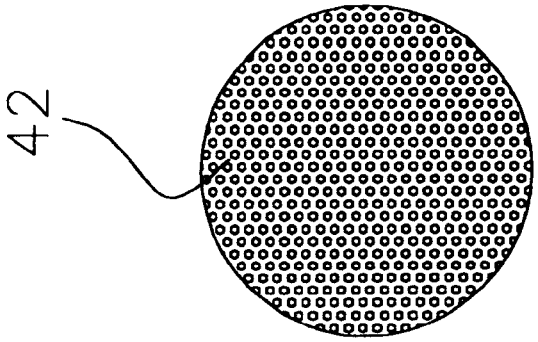
Figure 6:
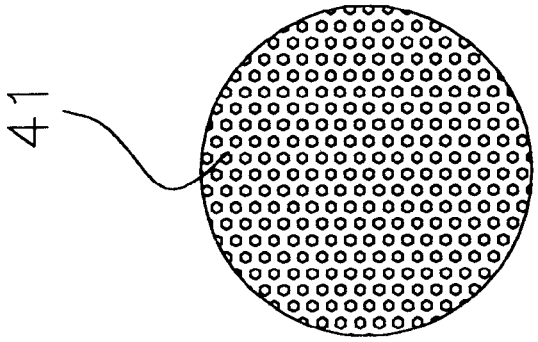
Figure 5:
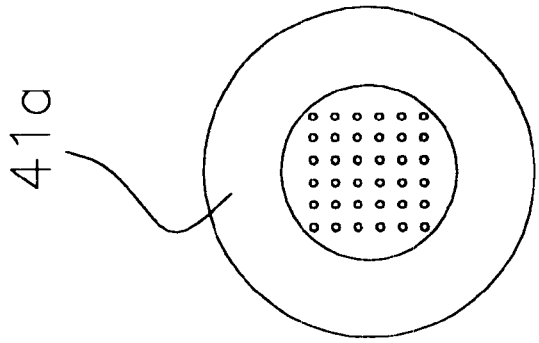

Referring now to deployment of the unit as illustrated in FIG. 4. Bulldozer 110 is fitted with cab 105, rams 101 and 104, and lift unit 100. Fire suppression unit 10 is supported by front mount 103 of lift unit 100 and positioned over well head 40 as bulldozer 110 moves in the direction of arrow 108. Once in position, ram 101 presses foot pad 106 down in the direction of arrow 107. This causes bulldozer 110 to lift at the rear and by pivoting around pivot point 102, transfers its weight to the containment unit 10 thereby increasing its stability over the well head 40. Bracket 12' denotes scope of travel of fire suppression unit 10.

What is claimed is:

1. An oil well fire suppression and containment vessel, said vessel comprising:

a water containment vessel having a top end and a bottom end, said water containment vessel having a lifting bar affixed on both sides of said top end, and an oil containment vessel having a top end and a bottom end, said oil containment vessel being contained within and axially aligned to said water containment vessel said second containment vessel forming a water containment vessel with said first containment vessel, a center pipe extending through and axially aligned to said first containment vessel and said second containment vessel, a plurality of perforated baffle plates mounted within said first containment vessel, each of said baffle plates being sequentially positioned on said center pipe, a cone shaped guide affixed to said first containment vessel aligned with said center pipe, said guide having an aperture formed therein, a plurality of liquid nitrogen tanks mounted on said top end of said water containment vessel, a plurality of connecting pipes and a plurality of heat activated valves, said connecting pipes running from said liquid nitrogen tanks and through said water containment vessel and connecting to said oil containment vessel, said heat activated valves for controlling the flow of liquid nitrogen into said oil containment vessel upon exposure to the heat of a burning oil well, and a plurality or vent pipes mounted on said oil containment vessel for conducting oil and gases from said oil containment vessel to a secure storage area.

2. An oil well fire suppression and containment vessel of claim 1 wherein a motor unit having a mechanical screw means is mounted above said center pipe and a rotatable shaft being extended through said center pipe and driven by said motor unit, said screw means having an expandable bladder mounted at a lower end for mechanically sealing the opening of an oil well.

3. An oil well fire suppression and containment vessel of claim 1 wherein a ballast box is attached to the outer surface of said water containment cylinder for weighting down said fire suppression and containment vessel to counter the force of the gushing oil and gas.

4. The combination of an oil well fire suppression and containment vessel of claim 1 and a bulldozer having a lift unit at a front end, and a foot pad at a back end; said lift unit for engaging said lifting bars and carrying said fire suppression and containment vessel to the oil well fire and lowering said suppression and containment vessel, said foot pad for lifting said bulldozer and adding the weight of said bulldozer to overcome the pressure of the oil and gases emitted by the oil well.

* * * * *